US007636961B1

(12) United States Patent
Starkey

(10) Patent No.: US 7,636,961 B1
(45) Date of Patent: Dec. 29, 2009

(54) TRANSPORT COT LIFT DEVICE

(76) Inventor: David L. Starkey, Normandy Creek Dr., Centerville, OH (US) 45458

( * ) Notice: Subject to any disclaimer, the term of this patent is extended or adjusted under 35 U.S.C. 154(b) by 246 days.

(21) Appl. No.: 11/541,895

(22) Filed: Oct. 2, 2006

Related U.S. Application Data

(60) Provisional application No. 60/724,057, filed on Oct. 5, 2005.

(51) Int. Cl.
*B66B 9/16* (2006.01)

(52) U.S. Cl. ..... 5/11; 5/611; 5/86.1; 187/234; 187/237; 187/242

(58) Field of Classification Search ..... 5/11, 5/611, 86.1, 509.1; 254/2 R, 2 B, 93 R; 187/234, 187/237, 240, 242, 244, 273; 296/20
See application file for complete search history.

(56) References Cited

U.S. PATENT DOCUMENTS 3,159,085 A * 12/1964 Branick ..... 91/451
3,302,927 A * 2/1967 Gray ..... 254/2 B
4,645,181 A * 2/1987 Schapansky ..... 254/2 B
5,022,105 A * 6/1991 Catoe ..... 5/11
5,135,350 A 8/1992 Eelman et al.
5,271,113 A 12/1993 White
5,328,153 A * 7/1994 Levinson ..... 254/2 R
5,537,700 A 7/1996 Way et al.
5,911,408 A * 6/1999 Berends et al. ..... 254/2 B
6,839,925 B2 * 1/2005 Myers ..... 5/509.1
2005/0229312 A1 * 10/2005 Bishop ..... 5/620

* cited by examiner

*Primary Examiner*—Michael Trettel
(74) *Attorney, Agent, or Firm*—Jacox, Meckstroth & Jenkins

(57) ABSTRACT

An end portion of a patient transport cot having a collapsible undercarriage is elevated by a lift device including a collapsible frame on caster wheels and supporting a power operated lift member. A head member is mounted on the lift member and supports adjustable hook members which releasably engage an end portion of the frame of the transport cot. In one embodiment, the lift member includes a fluid cylinder operated from a fluid supply tank through a control valve. In other embodiments, the lift member is operated by an electric motor driven mechanical actuator controlled by a switch. A support bracket provides for conveniently mounting the lift device on a door of a transport vehicle for storage.

17 Claims, 9 Drawing Sheets

TRANSPORT COT LIFT DEVICE

BACKGROUND OF THE INVENTION

This invention relates to a lift device to facilitate raising and lowering a patient transport cot to move a patient into and out of a patient transport vehicle. Patient transport cots are used to carry patients from a first place, such as a place of injury, to an ambulance to be transported to a specified place, such as a medical facility. Upon arrival at the latter place, the cot, with the patient still on it, is removed from the ambulance and guided to a certain location, such as an emergency room, in the specified place. The cot includes a bed portion supported on a collapsible undercarriage that, in turn, is supported on caster-mounted wheels. In addition to these wheels, the cot has front end wheels mounted just below the front end of the bed portion and ahead of the undercarriage.

When a cot is to be loaded into an ambulance, the front end of the cot, including the front end wheels, is rolled a short distance into the ambulance, but not so far as to interfere with folding the undercarriage to a retracted location just below the bed portion. Patient transport personnel controlling movement of the transport cot must then lift the rear end of the cot, so that the undercarriage wheels will be free of any weight on them. To do this, the front end wheels are used as a fulcrum against the floor of the ambulance, and the cot is supported entirely by the front end wheels at one end and transport personnel at the other end while the undercarriage is folded up to its retracted position. The cot, with the patient still on it, can then be pushed fully into the ambulance and anchored to floor-mounted fixtures.

Lifting the rear end of the cot and holding it in midair places a great strain on the transport personnel, depending on the combined weight of the cot, the patient, any medical equipment that must accompany the patient on the cot, and the distribution of all of that weight along the length of the cot. For example, patient transport personnel are sometimes required to lift, either individually or as a team, weights of up to nearly 400 lbs. An 80 lb. patient transport cot with a 200 lb. patient on it requires a single patient transport worker to lift only approximately 150 lbs. at the rear end of a patient transport cot, but a really heavy patient whose weight is closer to the transport cot limit of 650 lbs., could require one member of the patient transport crew to lift approximately 390 lbs. The equipment that accompanies the patient on the cot sometimes includes such things as incubators, IV pumps, compressed gas cylinders, and associated medical devices. While weight capacities of patient transport cots vary with design and may range between 450 lbs. and 650 lbs., bariatric patient transport cots are available for extremely heavy patients whose weight may exceed 800 lbs. The height of the floor of patient transport vehicles, such as ambulances, above street level typically averages between 30" and 34" and while the cot and the patient on it are either being placed in the ambulance or taken out of it, the transport personnel will have to support the maximum weight in that region of height.

Lifting such weights to raise the undercarriage wheels of the cot off the ground and support the cot at that level can and does result in injuries to patient transport personnel and may also result in accidental collapse of the patient cot, potentially injuring the patient. Furthermore, the lifting effort of two or more transport personnel may not be optimally correlated, resulting in one of them suddenly having to bear a larger fraction of the weight than was expected.

When the ambulance reaches its target place, either the medical facility or another place, the cot, still carrying the patient, must be removed from the ambulance by a procedure basically the opposite of that used in getting the cot and patient into the ambulance. The cot must be disengaged from the floor-mounted fixtures to allow patient transport personnel to roll the foot end of the cot out to the edge of the floor of the ambulance. One or more patient transport personnel must then support that end of the cot at about that level above the ground so that the cot can be pulled far enough out of the ambulance to allow the undercarriage to be extended to a load-bearing position and locked in place while keeping the head end wheels on the floor of the ambulance. Only then can the transport personnel allow the cot to be lowered the rest of the way so that the undercarriage wheels are on the ground and can support all of the weight.

SUMMARY OF THE INVENTION

It is an object of this invention to provide a lift device comprising engagement means to engage an end portion of the frame of a patient transport cot; means to supply controlled force to the engagement means to move the engagement means up and down, selectively; central support means to support the engagement means; and wheels connected to the support means to allow the lift device to be rolled in controlled directions.

Much, if not all, of the weight that is currently lifted and supported by transport personnel is thus lifted and supported by the lift device of this invention, which addresses the safety of both the patient transport personnel and the patient. All that remains for the patient transport personnel to do is to push the loaded patient cot into an ambulance during loading and, later, to pull it back out when the ambulance reaches its intended destination. The lifting and supporting force may be obtained using electro-mechanical or hydro-mechanical means or by a compressed gas system. The latter, with its built-in cushioning and inherent air ride suspension, promotes smooth vertical loading and unloading movements.

Further, a patient transport cot lift device constructed in accordance with this invention may be constructed so that it is lightweight and portable and can be easily collapsed to be stored in the patient transport vehicle and easily released from the vehicle and attached to a patient transport cot.

DETAILED DESCRIPTION OF THE INVENTION

Reference numbers that identify components that perform a certain function in one of the following embodiments will continue to be the same in later embodiments when those components continue to perform the same functions.

Figure 1:
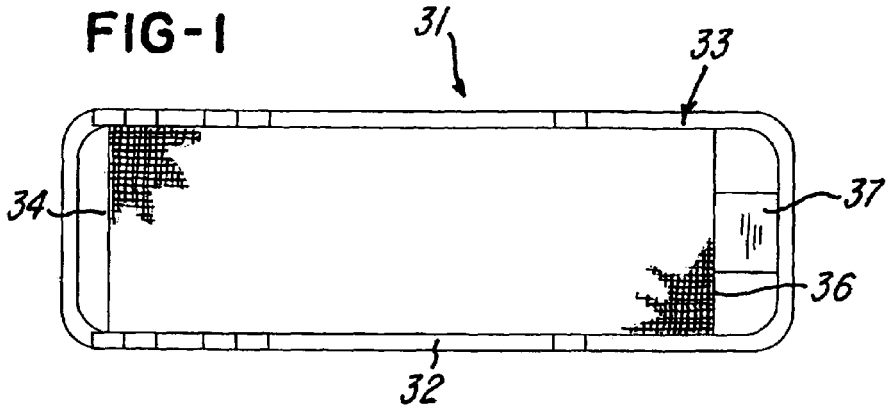
FIG. 1 is a plan view of a prior art patient transport cot.

The prior art patient transport cot 31 in FIG. 1 has a tubular perimeter frame 32 around a bed area 33 on which the patient is to be placed with the patient's head at the head end 34. At the opposite, or foot, end 36 of this cot, is a center plate 37, although not all types of patient transport cots have such a plate.

Figure 2:
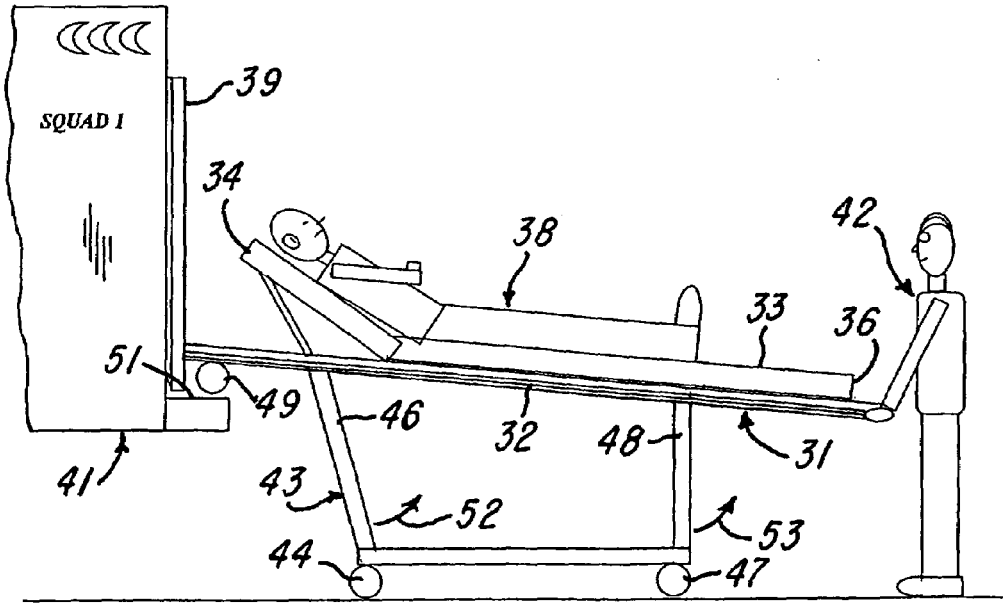
FIG. 2 shows a simplified diagrammatic side view of the patient transport cot of FIG. 1 with a patient on it and with the cot in position to be loaded into a patient transport vehicle in accordance with the prior art.

FIG. 2 shows, in simplified form, the patient transport cot 31 carrying a patient 38 on it and in position to be loaded through a doorway 39 at the rear of an ambulance 41, in accordance with the way such loading has commonly been done. Only one member or person 42 of the patient transport crew responsible for moving the cot about is shown standing at the foot end 36 of the cot 31, although there may be two or more crew members for each cot.

The cot 31 is supported by a collapsible undercarriage 43 that has a front set of caster-mounted undercarriage wheels 44 pivotally mounted on a front support 46 and a rear set of caster-mounted undercarriage wheels 47 pivotally mounted on a rear support 48 to allow the cot to be easily guided as it is rolled from place to place. Just below the frame 32 at the head end 34 of the cot 31 and ahead of the undercarriage 43 is another pair of wheels referred to as head end wheels 49. As the cot is being moved into the rear doorway 39 of the ambulance, the head end 34 of the cot 31, including the head end wheels, is high enough above the ground to enter the doorway with the head end wheels at or just above the level of the floor 51 of the ambulance 41.

After the head end wheels 49 have entered the ambulance, the transport person 42, perhaps with the assistance of other transport personnel, lifts the foot end 36 of the cot 31, thus pressing the head end wheels against the floor of the ambulance 41 and pivoting the cot about those wheels. As the transport person pivots the cot 31 about the wheels 49, the under carriage wheels 44 and 47 are lifted off the ground, and with no weight pressing these wheels against the ground, the undercarriage can be collapsed by pivoting the supports 46 and 48 to the rear, as indicated by arrows 52 and 53. The entire weight of the cot 31, plus the patient 38 and any medical equipment also on the cot, is then borne by the head end wheels 49 and the patient transport personnel 42. The undercarriage wheels of some patient transport cots do not fold to the rear, but in any case, the weight pressing the undercarriage wheels down has to be lifted up before the undercarriage can be folded up. When the supports have been pivoted far enough to raise the wheels 44 and 47 to at least the level of the floor of the ambulance 41, the cot can be pushed all the way into the ambulance.

Figure 3:
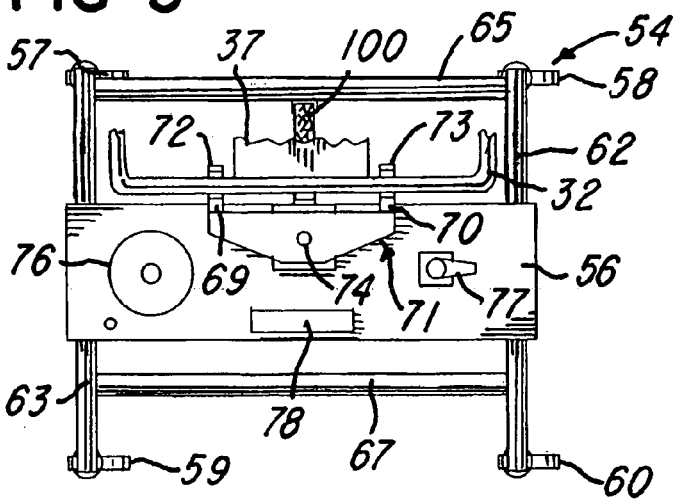
FIG. 3 is a top view of one embodiment of a lift device according to this invention with a fragment of the foot end of a patient transport cot resting in hooks on the lift device.

FIGS. 3-8 show one embodiment of a lift device 54 and components thereof according to this invention. FIG. 3 is a view looking vertically down on the lift device, which comprises a horizontal platform or support member 56 on swivel wheels 57-60 attached to the lower ends of legs 61-64 pivotally connected to the platform or support member. The front legs 61 and 62 are rigidly joined together by a bar 65 near their lower ends to pivot as a unit about an axis 66 at their upper ends. Similarly, the rear legs 63 and 64 are rigidly joined together by a bar 67 to pivot as a unit about an axis 68.

Only a fragment of the foot end 36 of the peripheral frame 32 of the cot is shown extending across hooks 69 and 70 attached to a lift head 71. The upwardly extending free ends 72 and 73 of the hooks 69 and 70, respectively, are slightly lower than the foot end when the undercarriage 43 is fully extended as it is in FIG. 2 which allows the free ends of the hooks to pass under the foot end of the cot. These hooks are spaced apart to provide balanced lifting force, and by being spaced apart, they engage the peripheral frame on opposite sides of the center plate 37, if the cot 31 has such a plate.

The lift head is supported by a shaft 74 that is moved up and down from below to raise, support, and lower the foot end 36 of the cot, as has been described with reference to FIG. 2. The apparatus for achieving and controlling these movements of the lift head and the cot will be described hereinafter.

It is to be noticed that the weight bearing down on the lift head 71 when the foot end of the cot is lifted off the ground presses vertically down at a pressure point 75 that is forward of the shaft 74 but is still within the stable footprint bounded by the locations of the wheels 57-60 at every instant. Locating the force within that area prevents the lift device 54 from tipping over, as it could do if the pressure point were forward of the footprint.

It should also be noted that the distance between the front legs 61 and 62 in this embodiment is greater than the width of the foot end 36 of the frame, which is consistent with having the pressure point 75 within the footprint. However, the spacing between the front legs 61 and 62 may be less than the width of the foot end 36 if the undercarriage 43 is so constructed that it will not intersect any part of the lift device 54 as the undercarriage is being collapsed or expanded.

The support member 56 in this embodiment has a hole 76 (FIG. 3) to receive a compressed air tank (which is not shown in this figure) to provide the force necessary to elevate the lift head 71 and the foot end of the cot. A control knob or handle 77 is attached to a valve and is mounted on the opposite side of the support member 56 from the location of the air tank hole. In order to raise the lift head 71 and the foot end 36 of a cot being placed in an ambulance, it is preferable to require that the control knob or handle 77 be turned counterclockwise. Then, when the foot end of a cot is to be lowered, the control knob will be required to be turned clockwise so that the hand of the transport personnel operating the control knob will be moving away from the path of the descending lift head 71.

A convenient carrying and guiding handle 78 is attached to the support member 56 so that anyone moving the cot in and out of an ambulance and from place to place can easily guide it by means of this handle.

Figure 5:
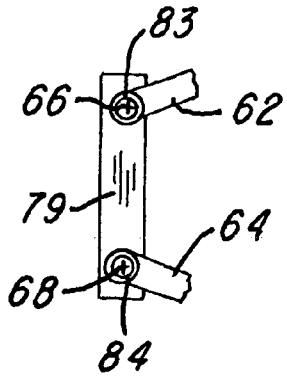
FIG. 5 shows one of the leg supports in FIG. 4.
Figure 4:
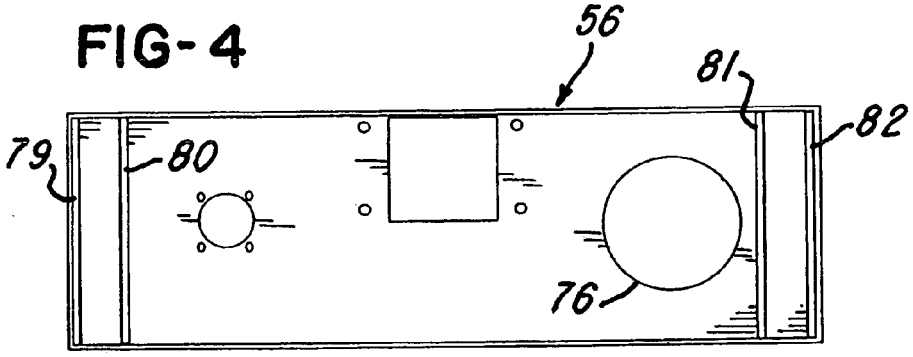
FIG. 4 shows the underside of the support member in FIG. 3.

FIG. 4 shows the underside of the support member 56, which is a shallow, four-sided tray in this embodiment with four identical axle support plates welded to it in parallel pairs 79, 80 and 81, 82. The plate 79, which is similar to the other three axle support plates, is shown in FIG. 5 as having two axle holes to receive axles 83 and 84 for one of the front legs 61 and the corresponding rear leg 63 directly behind that front leg.

Figure 6:
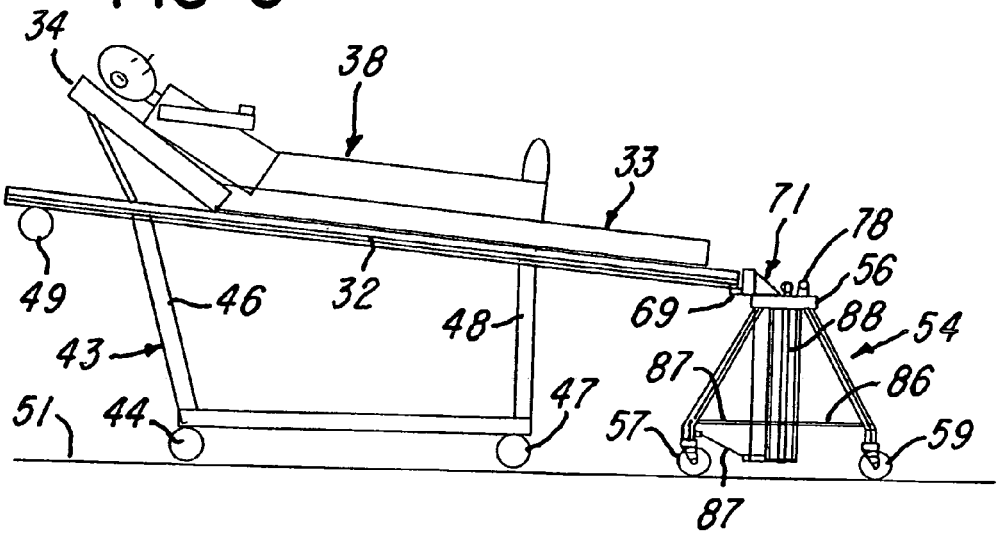
FIG. 6 is an elevational view of the patient transport cot lift device in FIG. 3 from the side with the lift head fully lowered to receive the foot end of a patient transport cot.

FIG. 6 shows the lift device 54 with the lift head 71 in its lowest position in which the hooks 69 and 70 are being rolled under the foot end 36 of the cot 31. Articulated side struts 86 and 87 join the pair of front legs 61 and 62 to the pair of rear legs 63 and 64, respectively, to assure that the pairs of legs pivot as units and to limit the extent of angular separation of the rear legs from the front legs. A tank 88 of compressed air is suspended from the support member 56 in a frame 89 from which it can easily be removed and replaced, and it is provided with a standard pressure regulator control 90.

Figure 7A:
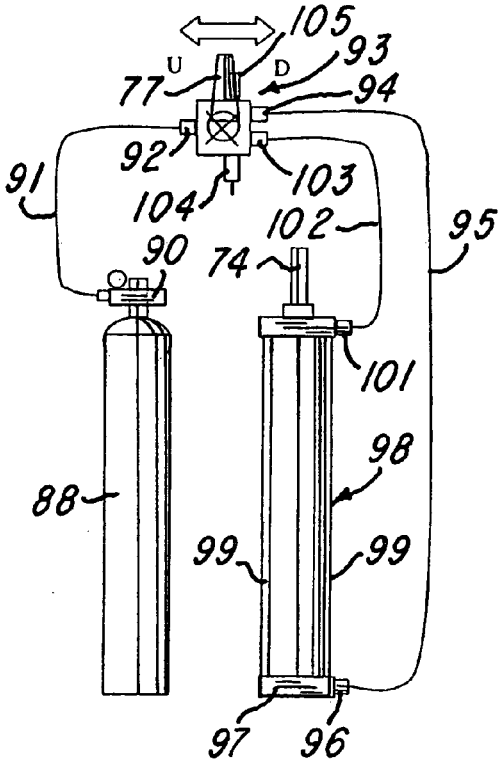
FIG. 7A is a schematic drawing of a pneumatic system to raise and lower the lift head in FIG. 6.
Figure 7B:
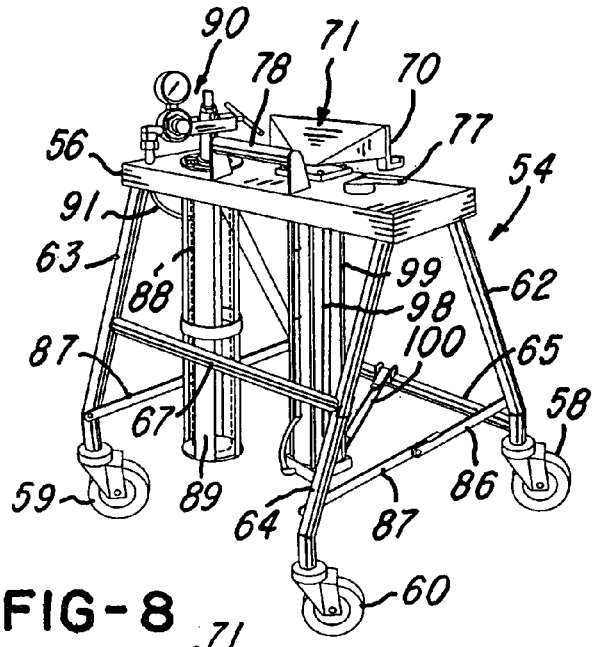
FIG. 7B is a perspective front view of the patent cot lift device with the lift head retracted.

As shown partially in FIG. 7A and more completely in FIG. 7, a tube 91 connects compressed air from the pressure control 90 to an input port 92 of a valve 93. When the lift head 71 is to be raised to lift the foot end of a cot, the knob or handle 77 of this valve 93 is turned counterclockwise to the location marked U to open a passage to a controlled extent to allow compressed air to pass through a channel in the valve from the input port 92 to a second port 94 to which a tube 95 is connected. The tube 95 leads to a port 96 in a base 97 at the lower end of a double acting pneumatically operated cylinder 98. This cylinder is supported and stabilized by a frame comprising vertical rods 99 joined to the base 97. Another stabilizing device is a sturdy cloth strap 100, one end of which is secured to the bar 65 and the other end of which is secured to the cylinder base 97.

It is the compressed air directed through the port 96 into the lower part of the cylinder 98 that provides the force to move a piston inside the cylinder upward to raise the shaft 74. This raises the lift head 71 and, with that, the foot end of the cot. At the same time, air from the upper part of the cylinder is allowed to escape via a port 101 and a tube 102 to another port 103 in the valve 93. The air that enters the port 103 in this direction goes through the valve 93 along a passage that leads to a filter-muffler unit 104. The height to which the lift head 71 is raised is controlled by how much air flows into the lower part of the cylinder 98, and the speed with which it is raised is controlled by how far the knob or handle 77 is turned counterclockwise and by the filter-muffler 104, which controls the rate of escape of air from the upper part of the cylinder. The compressibility of the air provides a cushioning effect that keeps any too-sudden upward movement of the foot end of the cot from jarring a patient. At the same time, the muffler action of the filter-muffler unit 104 limits the noise that would be produced by air exiting too quickly from the upper part of the cylinder 98 via the tube 102 and through the valve 93. When the foot end of the cot reaches the desired height, the knob 77 is turned clockwise to a central location that closes the valve 93 and allows no more air to escape.

When the lift head 71 is to be lowered, the knob is turned further clockwise from its central position to the position marked D (FIG. 7) to open a passageway through the valve 93 from the pressure control regulator 90 to the port 103 and from there through the tube 102 to the port 101 at the top of the cylinder 98 to allow compressed air to reach the upper part of the cylinder. The same movement of the knob opens a passageway through the valve 93 from the port 94 to a second filter-muffler 105, which functions like the filter-muffler 104 to control the rate at which air can pass through it and thus escape from the lower part of the cylinder. This controls the speed of downward movement of the lift head 71 and whatever is supported by it.

Figure 8:
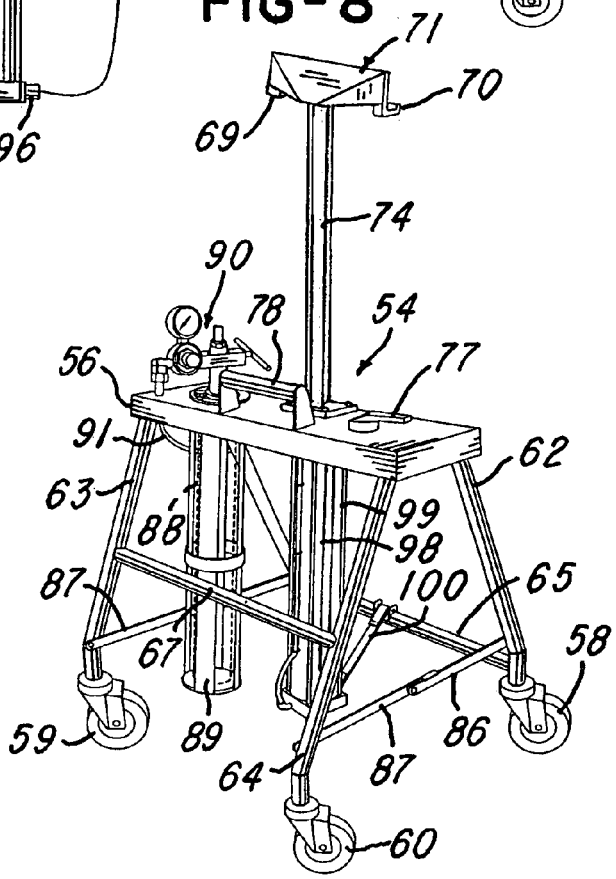
FIG. 8 is a perspective front view of the patient transport cot lift device in FIG. 6 with the lift head elevated in accordance with this invention.

FIG. 8 shows the lift device 54 with the shaft 74 extending upwardly from the cylinder 98 as it would be when the cot 31 was at a height to be loaded into an ambulance. As may be seen, the shaft is not round but polygonal, and it passes through a correspondingly shaped opening at the top of the cylinder. The non-cylindrical shape of the shaft prevents the shaft and the lift head from rotating and becoming disengaged from the cot. The shape also holds the lift head in a consistent position as it moves up and down. In this embodiment, the shaft 74 has a hexagonal cross-section, but it could have other cross-sectional shapes that were not perfect circles and would prevent it from rotating.

Figure 9:
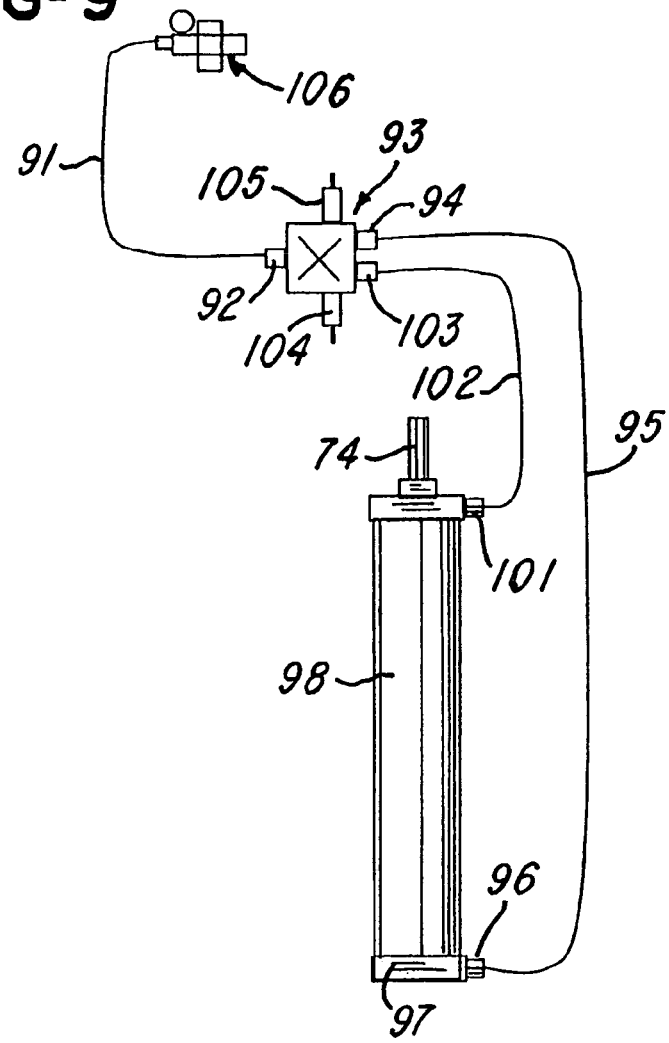
FIG. 9 shows a modified pneumatic system similar to that in FIG. 7.

FIG. 9 is a schematic of a pneumatic circuit similar to that in FIG. 7 except that the compressed air comes from an external source 106 not carried on the lift device. In such a case, the source would normally be carried on the ambulance that the lift device serves, and the movement of the lift head would be just as smoothly controlled as if the air source were on the lift device, itself. This would make a tank on the lift device unnecessary, which would allow the lift device to be smaller and lighter than that in FIGS. 6, 7A and 8. However, an air tube of considerable length would be required to allow the lift device to be moved very far away from the ambulance it is to serve.

The connections to the cylinder 98 and the valve 93 in FIG. 9 are the same as those in FIG. 7 and their description will not be repeated. The pneumatically operated device in both of these embodiments, having only one moving part, would be reliable and economical to operate. The regulated compressed gas input self-limits the lift capacity. In addition, no electrical components are required in these embodiments.

Figure 10:
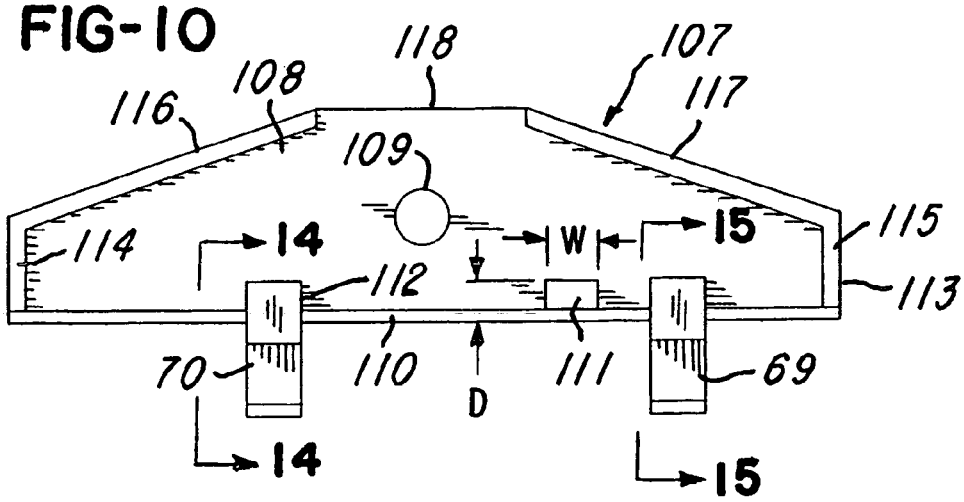
FIG. 10 is a top view of the lift head in FIG. 6.

Some patient transport cots require the hooks on the lift head to be spaced farther apart than those used in conjunction with other cots. FIG. 10 is a top view of a lift head 107 that facilitates setting the hooks at selected spacings and locking them there. In this embodiment, the lift head is basically an open shell with a relatively thin base 108 in which there is a central hole 109 just large enough for a strong bolt to pass though and be screwed tightly into an internal thread in the upper end of the shaft 74. A front wall 110 extends along the front edge of the base from which it rises perpendicularly, and there are two slots 111 and 112 that extend into the base from the front surface of the front wall. In this embodiment, these slots are equidistant from the center of the front wall and are each just wide enough to receive part of a respective one of the hooks 69 and 70. In this figure, the hook 70 is shown in an intermediate stage of being connected to the lift head 107 so that part of that hook is in the slot 112. The hook 69 has already been fully inserted in the position on the wall 110 in which it will be used. Therefore, the hook 69 is offset toward the end 113 of the front wall.

At the two ends of the base 108 are short end walls 114 and 115 perpendicular to both the base 108 and to the front wall 110. These end walls, which slope downward toward the base, join two other walls 116 and 117, respectively, that are at an obtuse angle with respect to each other and terminate where they intersect a back edge 118 of the base. The upper edges of the walls 114-117 slope downwardly toward the base as they progress from the front wall.

Figure 11:
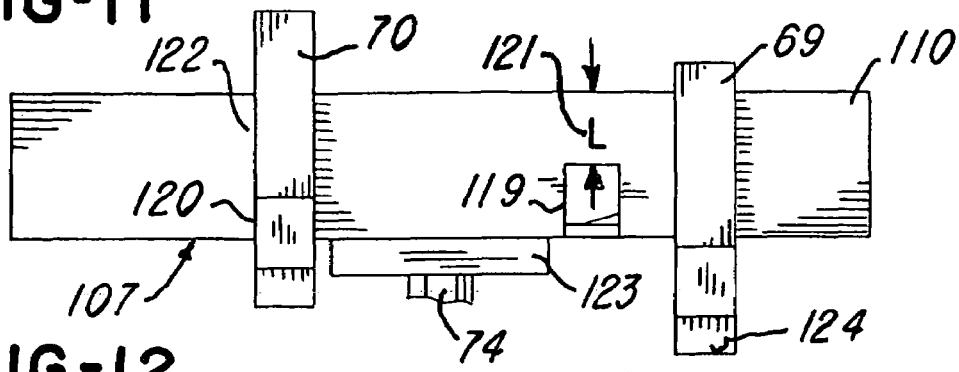
FIG. 11 is a front view of the lift head in FIG. 6.

FIG. 11 is a front view of the lift head 107 showing two vertical slots 119 and 120 in the front wall 110 aligned with the slots 111 and 112 and starting at the intersection of the front wall 110 and the base 108. The parts of the front wall directly above the slots 111 and 112 are identified by reference numerals 121 and 122. Each of these parts has a vertical dimension L. Also shown in this figure is an edge view of a slab or plate 123, which is attached to the underside of the base and has a short part of the shaft 74 extending perpendicularly down from it.

Figure 12:
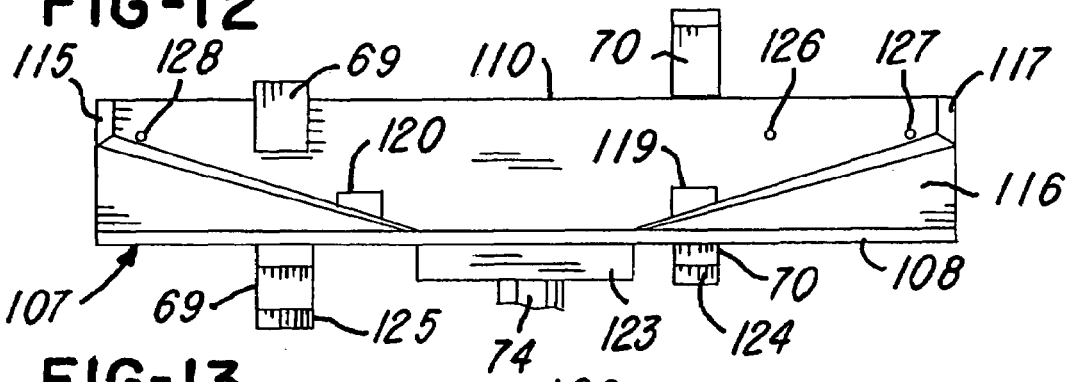
FIG. 12 is a rear view of the lift head in FIG. 6.

FIG. 12 shows the back side of the lift head 107 in which there are two sets of detent indentations in the rear face of the front wall 110. One set consists of the indentations 126 and 127 for properly locating the hook 70. The other set also includes a pair of indentations, but of this pair, only the indentation 128 is visible. The second indentation of this pair is covered by the hook 69. These sets of indentations mark locations where the hooks 70 and 69 are to be placed to accommodate configurations of different designs of patient transport cots.

Figure 13:
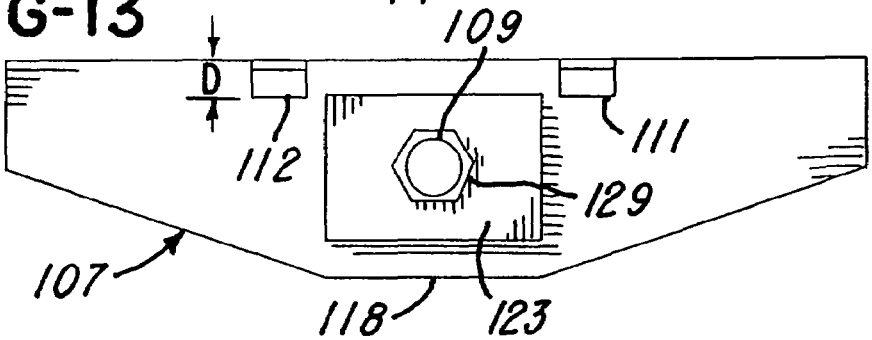
FIG. 13 is a bottom view of the lift head in FIG. 6.

FIG. 13 shows the underside of the lift head 107. The relatively thick slab or plate 123 greatly strengthens the base 108, which is where the stress is concentrated when the lift head is supporting a loaded patient transport cot. The shaft is not shown, instead, a hexagonal hole 129 into which the upper end of the shaft is inserted, preferably force-fitted. Coaxial with that hole is the round hole 109 through which the bolt referred to in FIG. 10 can pass and be threaded into an internally threaded hole within the top end of the shaft.

Figure 14:
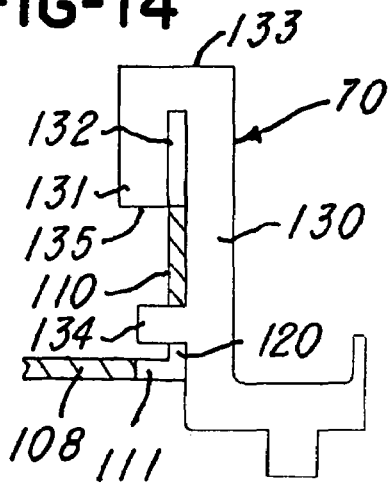
FIG. 14 is a cross-sectional view of one of the hooks and the lift head at the location 14-14 in FIG. 10.

FIG. 14 is a cross-sectional side view of the front wall 110 and the base 108 of the lift head. A side view of the hook 70, which is shown partially in place on the front wall, has a front vertical part 130 and a rear vertical part 131 parallel to the front vertical part and separated from it by a vertical slot 132 that has a width that accommodates the thickness of the front wall 110. The top ends of these vertical parts are joined together by a top part 133 that forms the upper end of a vertical slot which extends downward from the top part 133 by the length which is equal to the length L so that when the hook 70 is fully pressed down, its front and rear vertical parts embrace the upper part 121 of the wall 110.

A projection 134 extends perpendicularly from the rear surface of the front vertical part 130 directly toward the rear of the lift head 107 by a distance short enough and narrow enough to allow that projection to fit in the slot 111 of horizontal length D. The vertical distance from the top of this projection 134 to the lower end 135 of the rear vertical part 131 of the hook is at least as great as the vertical length L of the part 121 of the front wall 110. This allows the projection 134 to pass under the part 121 as the hook 70 is slid along the horizontal slot 111 toward the rear of the base 108. This movement of the hook 70 continues until the front vertical part 130 is against the front surface of the wall 110 and the slot 132 is aligned with the wall 110. The hook can then be pressed downwardly so that the projection 134 passes through the slot 111. When the top part 133 of the hook engages the upper edge of the front wall, the hook will be in its proper vertical position relative to the front wall, and the projection 134 will be beneath the base 108, allowing the hook 70 to be slid horizontally along the front wall 110 to a position as far from the end wall 115 as the hook 69 is from the end wall 114. Then a spring-biased projection 137 securely held in the hook will be aligned with one of the detent indentations 126, which is symmetrical with the position illustrated by the hook 69 in each of FIGS. 10-12.

Figure 15:
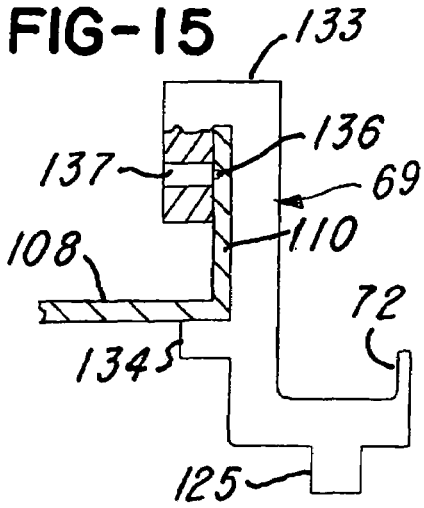
FIG. 15 is a cross-sectional view of the lift head at the location 15-15 in FIG. 10.

The hook 69 is shown in cross section in FIG. 15 to make visible a detent structure 137, such as is typically found in each hook, and it can be seen in this figure that the small, spring-biased projection fits into an indentation 136, which is the one of the indentations that is hidden by the hook 69 in FIG. 12. It can also be seen in this figure that the projection 134, that corresponds to the projection 134 in FIG. 14, has been slid downwardly through the slot 111 and then sidewards to the position in FIG. 12, is underneath a solid part of the base 108 in which it helps strengthen the hook against downward pressure due to the weight of a cot. A small projection 125 extends down from the hook 69 to engage a support provided to store the lift device 54 as will be described later.

Figure 16:
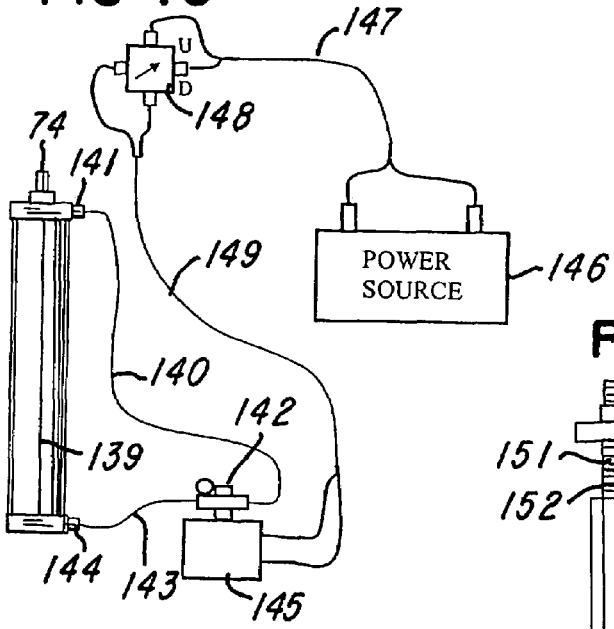
FIG. 16 shows a hydraulic system for raising and lowering the lift head in FIG. 6.

FIG. 16 shows an alternative means of raising and lowering the lift head 107 at the upper end of the shaft 74 extending from the upper end of a cylinder 139 carried on a lift device generally similar to the lift device 54 described in connection with FIGS. 3-8. The force to move the lift head is provided by hydraulic pressure in a closed system in which the volume of hydraulic fluid remains constant instead of the system previously described in FIGS. 6 and 8 using compressed air, some of which escapes with each movement of the piston inside the cylinder 98. The hydraulic system comprises a closed loop that includes the hydraulic cylinder 139, a tube 140 connected from a port 141 at the top of the cylinder to one side of a pump 142, and a tube 143 connected from the other side of the pump to a port 144 at the lower end of the cylinder. The pump is operated by an electric motor 145 supplied with electric power from a source 146 that can be carried on the lift device or in the ambulance served by the lift device. Electric power is connected from the source to the motor through an electric cable 147, control means 148 that includes a switch to determine the direction of current flow depending on whether a cot supported on the lift head 107 is being raised or lowered, and a second electric cable 149 connecting the control means to the motor.

To raise the lift head from the position in which it initially engages a transport cot, the motor driving the pump is run in the direction to transfer hydraulic fluid out of the upper part of the cylinder above the piston by way of the upper port 141 and into the part of the cylinder 139 below the piston. Lowering the lift head and cot from the elevated position, requires using a control means or switch 148 to reverse the direction of flow of hydraulic fluid, leaving the cylinder by way of the lower port 144 and returning to the upper part of the cylinder 139 through the upper port. The speed of raising and lowering the lift head 107 can be controlled by the control means or switch 148, which determines the rate of transfer of electric power to the motor.

Figure 17:
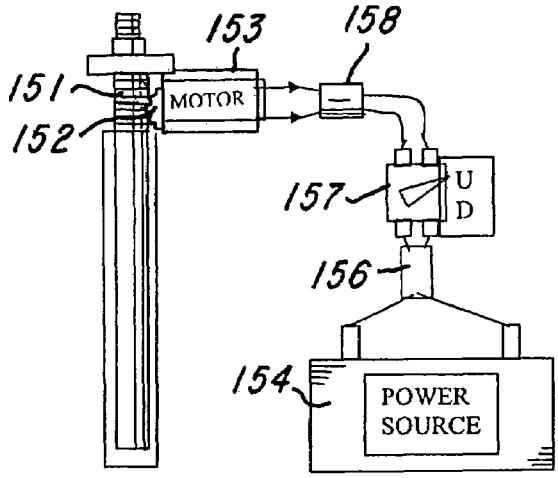
FIGS. 17-20 show electro-mechanical means for raising and lowering the lift head in the lift device in FIG. 6.

FIG. 17 shows mechanical means comprising a rack 151 that essentially takes the place of the shaft 74 for moving the lift head 107 vertically. The rack is moved vertically by a pinion 152 driven by a motor 153 which receives power from an electric source 154. The source is connected by an electric cable 156 to control means or switch 157, which, in turn, is connected to the motor by a second electric cable 158. As in previous embodiments, the control means or switch can be set to upward and downward positions to control the direction of rotation of the pinion and, thus, the upward or downward movement of the rack 151 and the lift head 107.

Figure 18:
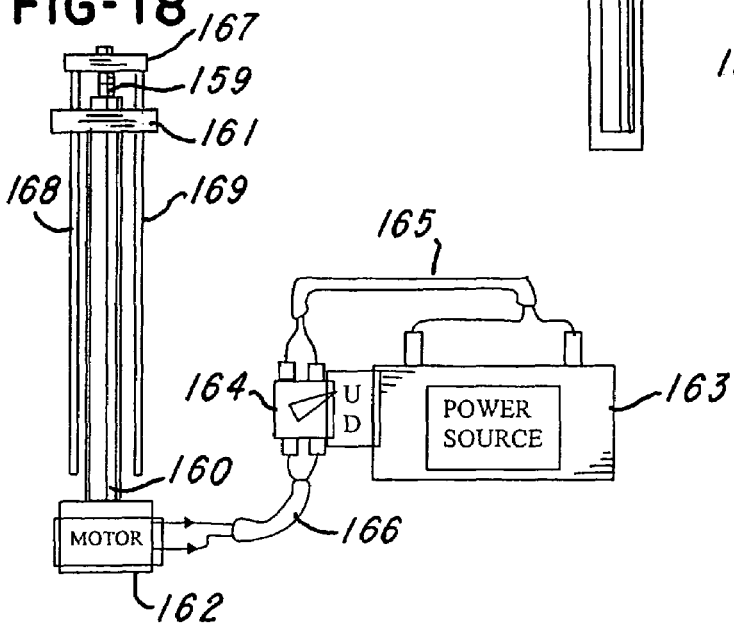

FIG. 18 shows a mechanical arrangement for moving the lift head 107 vertically. This arrangement comprises a worm gear 159 driven by an internally threaded sleeve gear 160 on a support structure 161. The sleeve gear is rotated by a motor 162 that obtains its power from an electric power source 163 connected to the motor by means of a series circuit that comprises control means or switch 164 connected to the source by a first electric cable 165 and to the motor by a second electric cable 166. In order to keep the worm gear from rotating with the sleeve, a yoke 167 is connected to the worm gear, and two guide rods 168 and 169 extend downwardly from the yoke through a fixed guide that allows the rods to move only vertically. The lift head is fixedly mounted atop the worm gear, which takes the place of the shaft 74 of previous embodiments. Since the worm gear does not rotate, the lift head moves only vertically and does not rotate.

Figure 19:
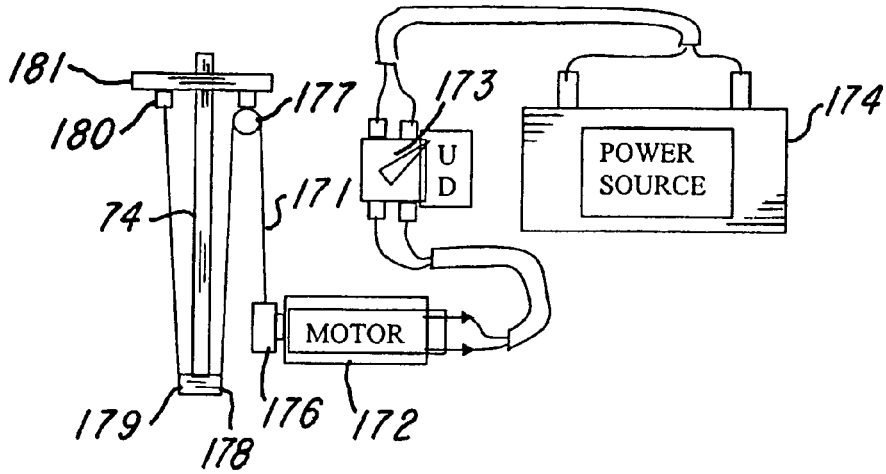

FIG. 19 shows a cable 171 driven by a motor 172 for raising and lowering the shaft 74 vertically. In order to raise the shaft, the control knob of a reversible control means or switch 173 is moved to its U position to connect the motor 172 to a power source 174, which may be a battery mounted on the lift device or in an ambulance with which the lift device is associated. This connection to the power source is in the proper polarity to cause the shaft of the motor and a drum 176 mounted on that shaft to rotate in the direction to pull on one end of the cable. The cable is looped over a pulley 177 mounted on the underside of a support member 181 and then under a pair of pulleys 178 and 179 at the bottom of the shaft 74 and finally is attached to an anchor 180 mounted on the underside of the support member 181, similar to the lift device 54 in previous embodiments. The cable is essentially of fixed length and has one end portion wrapped on the drum 176 so that rotating the drum in one direction causes part of the cable from the first pulley 177 to the anchor 180 to become shorter, which lifts the shaft 74 and any cot having a foot end supported by it. Reversing the control means or switch 173 reverses the direction of rotation of the motor and drum 176 and allows the weight of the shaft 74 and any load supported by it to descend.

Figure 20:
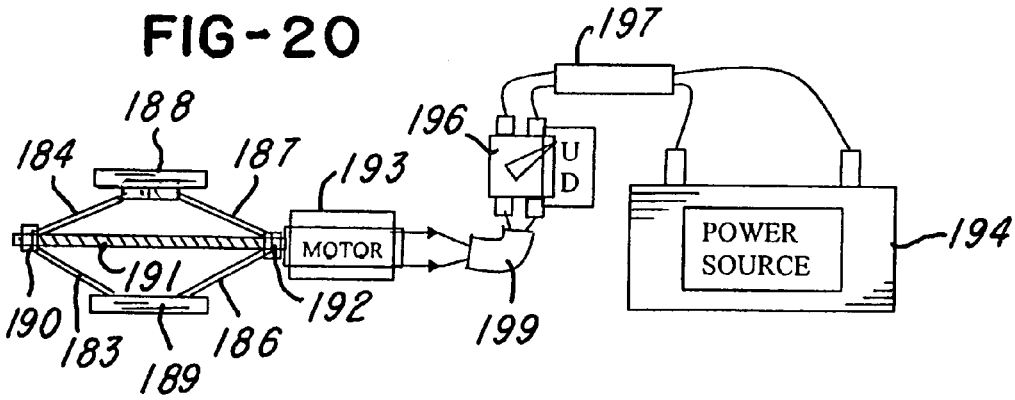

FIG. 20 shows another power operated means for raising and lowering the lift head 107. In this embodiment, the lift head is supported on two sets of jointed legs 183, 184 and 186, 187. The upper pair of legs 184 and 187 are pivotally mounted to a platform 188 that directly supports the lift head 107, while the legs 183 and 186 are pivotally mounted on a base 189, which corresponds to the support member 56 in FIGS. 6 and 8. The legs 183 and 184 are pivotally joined to a yoke 190 rotatably attached to one end of a worm gear 191, and the legs 186 and 187 are joined together by an internally threaded yoke 192 that bears against a fixed member, which, in this case, is an electric reversible drive motor 193. The motor receives power from a source 194 by way of a series circuit comprising switch or control means 196, a first electric cable 197 connecting the control switch to the source 194, and a second electric cable 199 connecting the control switch to the motor. When it is desired to raise the lift head 107, the control switch is set to direct power to the motor in a polarity to rotate the shaft of the motor in the direction to draw the yoke 190 toward the yoke 192. When the lift head is to be lowered, the control switch directs power from the source 194 to the motor in a polarity to cause the worm gear 191 to rotate in the reverse direction, thereby driving the yokes 190 and 192 apart.

Figure 21:
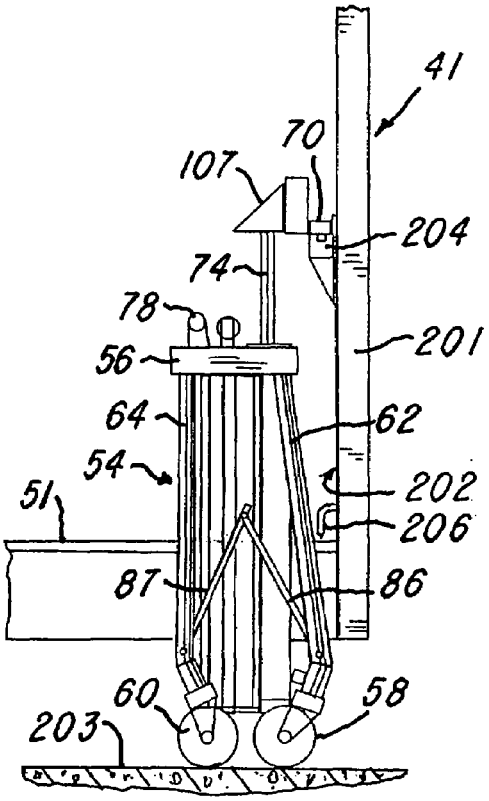
FIG. 21 shows the lift device of FIG. 6 approaching a door of an ambulance to be supported on it.

FIG. 21 shows the lift device 54 folded up to be placed in the ambulance 41. In this instance, it is convenient to hang the lift device on a side door 201 of the ambulance, although other ambulances are arranged in a way that makes it easier for the lift device to be hung on the rear door. In either case, a bracket 202 is attached to the inner surface of the door to support the lift device in its folded condition. When the lift device is folded as shown in this figure, the articulated side strut 87 that connects the front leg 65 to the rear leg 67 directly behind it, is folded up, thereby bringing those two legs almost parallel to each other and making the lift device 54 more compact. With the wheels 58 and 60 still on the pavement 203, the shaft 74 is extended, and the folded lift device is pushed adjacent the inner surface of the door. The extended shaft puts the lift head 107 just above the level of the bracket 202, and the lift device can be pushed slightly forward so that the hook 70 and the other hook 69, which is directly behind it in this view, are directly over a bar 204 at the upper end of the bracket. When the lift device 54 is in that position, the shaft 74 is retracted slightly so that the projection 125 in FIG. 15 and the corresponding projection 124 extending downwardly from the hook 69 enter a set of holes 221-224 provided for them in the bar 204. The shaft 74 is then retracted to raise the lift device 54 up to the position shown in FIG. 22 where the bar 65 is secured behind a hook 206 near the bottom end of the bracket 202, further holding the lift device in a fixed position. The door 201 may then be closed with the lift device secured within the ambulance.

Figure 22:
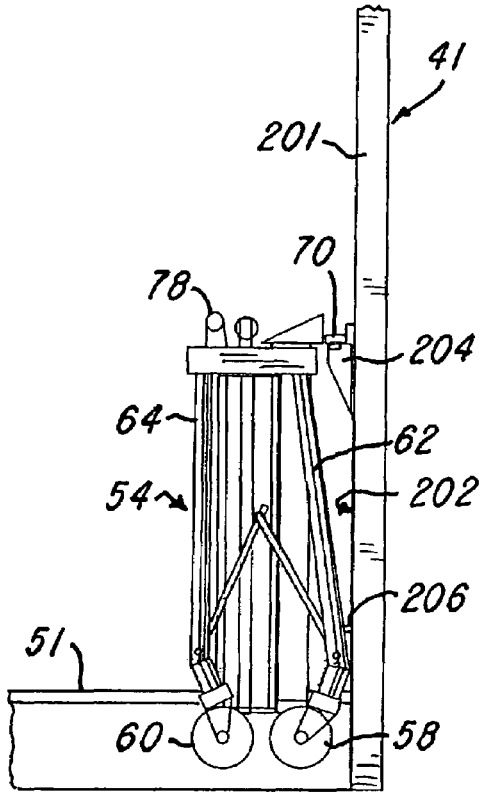
FIG. 22 shows the lift device in FIG. 6 supported on the door in FIG. 21.
Figure 23:
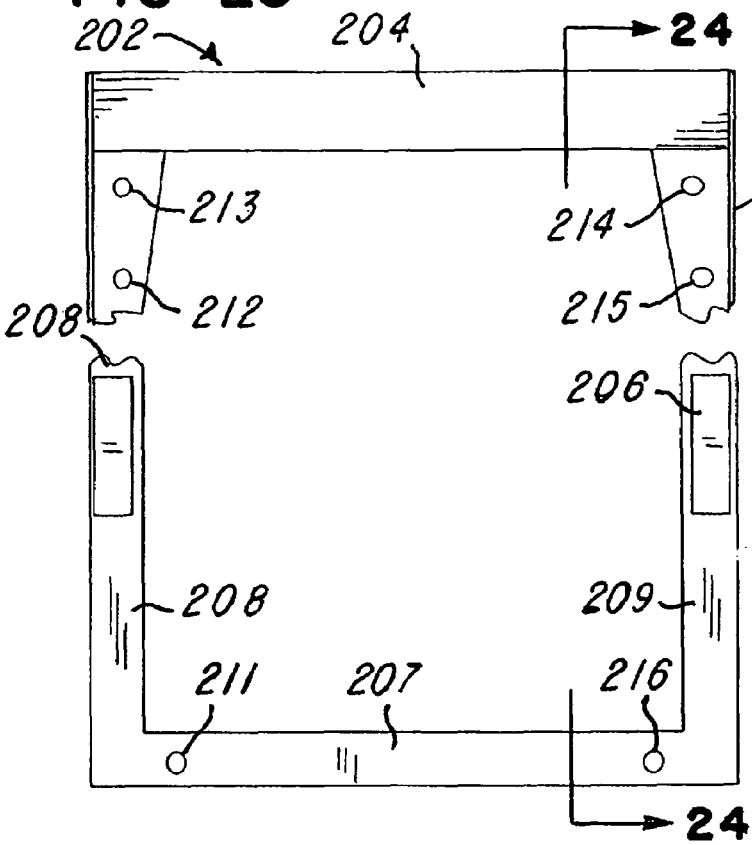
FIG. 23 is a front view of a bracket shown from the side in FIG. 21 for hanging the lift device on the side door of the ambulance.
Figure 24:
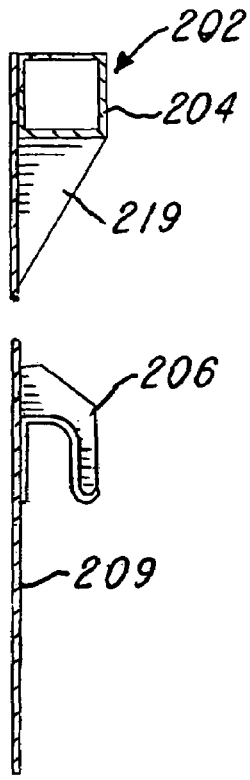
FIG. 24 is a cross-sectional view of the bracket in FIG. 23.

FIG. 23 is a front view of the bracket 202, the bottom part 207 and two side parts 208 and 209 of which are flat straps with bolt holes 211-216 through which bolts (not shown) are screwed into the door 201. The hook 206 and a laterally aligned second hook 217 are secured near the lower ends of the side parts 208 and 209, respectively. As shown in FIG. 24, the hooks 206 and 217 face downwardly so that when the lift device 54 is raised up, as shown in FIGS. 21 and 22, the bar 65 will slide in behind the hooks to be captured by them to hold the lower part of the lift device 54 securely.

Figure 25:
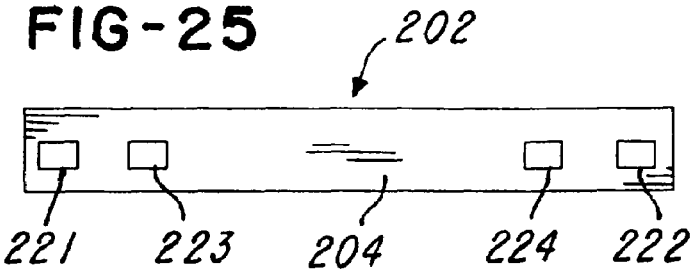
FIG. 25 is a top view of the bracket in FIG. 23.

FIG. 24 also shows that the bar 204 in the form of a hollow tube. This figure also shows that the outer edge of the side part 208 includes a triangular strengthening flange or bracket 218 at one end of the bar 204. A matching flange or bracket 219 is shown in FIG. 23 at the other end of the bar 204. The top view of the bracket 202 in FIG. 25 shows that the bar 204 has the four holes 221-224. These holes receive the projections 124 and 125 extending downwardly from the bottom of the hooks 69 and 70, and they are spaced apart by distances that align them with the detent indentations shown in FIG. 12.

While the forms of lift device herein described constitute preferred embodiments of the invention, it is to be understood that the invention is not limited to these precise forms of a lift device and that changes may be made therein without departing from the scope and spirit of the invention as defined in the appended claims.

What is claimed is:

1. In combination with an elongated patient transport cot including an elongated bed supported by a collapsible wheel supported undercarriage, a lift device for temporarily engaging and lifting an end portion of said cot to facilitate moving said cot and a patient thereon into and out of a patient transport vehicle, said lift device comprising a frame supported by a set of wheels, a head member releasably connected to said end portion of said cot, a generally vertically extending power operated lift member including an elongated fluid cylinder mounted on said frame and having a piston rod connected to said head member for raising and lowering said head member and said end portion of said cot, a tank of pressurized gas mounted on said frame and connected to said fluid cylinder, and a manually actuated control valve connected to control the flow of gas from said tank to said fluid cylinder for selectively operating said lift member for controlling the generally vertical movement of said head member and said end portion of said cot.

2. The combination of claim 1 wherein said piston rod has a non-circular cross-section to limit rotation of said piston rod and said head member relative to said frame.

3. The combination of claim 1 wherein said set of wheels comprise caster wheels and including a handle connected to said frame for conveniently moving said lift device in a universal direction with said caster wheels.

4. The combination of claim 1 wherein said head member supports at least one hook member releasably hooking said end portion of said cot.

5. The combination of claim 1 wherein said head member supports a set of horizontally adjustable hook members releasably hooking a peripheral frame on said cot.

6. The combination of claim 1 wherein said fluid cylinder comprises a double acting elongated hydraulic fluid cylinder, an electric motor driven pump unit connected to supply hydraulic fluid alternately to opposite end portions of said cylinder, and an electrical control switch connected to operate said motor driven pump unit.

7. The combination of claim 1 and including a support bracket adapted to be mounted on the patient transport vehicle, and said support bracket including attachment members for releasably engaging said head member and said frame of said lift device to facilitate mounting of said lift device on said support bracket in response to vertical movement of said head member by said power operated lift member.

8. In combination with an elongated patient transport cot including an elongated bed having a cot frame supported by a collapsible wheel supported undercarriage, a lift device for temporarily engaging and lifting an end portion of said cot to facilitate moving said cot and a patient thereon into and out of a patient transport vehicle, said lift device comprising a frame including a platform and a set of depending legs supported by a set of caster wheels, a head member releasably connected to said cot frame, a generally vertically extending power operated lift member supported by said platform and connected to said head member for raising and lowering said head member and said end portion of said cot, and a manually actuated control connected for selectively operating said lift member for controlling the generally vertical movement of said head member and said end portion of said cot.

9. The combination of claim 8 wherein said lift member comprises an elongated fluid cylinder supported by said platform and having a piston rod connected to said head member.

10. The combination of claim 9 and including a tank of pressurized gas supported by said platform and connected to said fluid cylinder, and said manually actuated control comprises a valve connected to control the flow of gas from said tank to said fluid cylinder.

11. The combination of claim 9 wherein said piston rod has a non-circular cross-section to limit rotation of said piston rod and said head member relative to said frame.

12. The combination of claim 8 wherein said set of legs are pivotally connected to said platform to provide for collapsing said lift device.

13. The combination of claim 8 wherein said head member supports a set of horizontally adjustable hook members releasably hooking said cot frame.

14. The combination of claim 8 wherein said power operated lift member comprises a double acting elongated hydraulic fluid cylinder, an electric motor driven pump unit connected to supply hydraulic fluid alternately to opposite end portions of said cylinder, and said control comprises an electrical control switch connected to operate said motor driven pump unit.

15. The combination of claim 8 and including a support bracket adapted to be mounted on the patient transport vehicle, and said support bracket including attachment members for releasably engaging said head member and said frame of said lift device to facilitate mounting of said lift device on said support bracket in response to vertical movement of said head member by said power operated lift member.

16. In combination with an elongated patient transport cot including an elongated bed supported by a collapsible wheel supported undercarriage, a lift device for temporarily engaging and lifting an end portion of said cot to facilitate moving said cot and a patient thereon into and out of a patient transport vehicle, said lift device comprising a frame supported by a set of wheels, a head member releasably connected to said end portion of said cot, a generally vertically extending power operated lift member supported by said frame and connected to said head member for raising and lowering said head member and said end portion of said cot, a manually actuated control connected for selectively operating said lift member for controlling the generally vertical movement of said portion of said cot, and wherein said frame supported by said set of wheels includes a set of collapsible legs pivotally connected to and projecting downwardly from a platform supporting said power operated lift member.

17. The combination of claim 16 wherein said power operated lift member comprises an a motor driven mechanical actuator connected to raise and lower said head member.

* * * * *